US012473650B1

(12) United States Patent
Nelson et al.

(10) Patent No.: US 12,473,650 B1
(45) Date of Patent: Nov. 18, 2025

(54) ELECTROLESS PLATING SYSTEMS AND METHODS

(71) Applicant: The Boeing Company, Arlington, VA (US)

(72) Inventors: Brian R. Nelson, St. Charles, MO (US); Vance N. Petitt, St. Louis, MO (US)

(73) Assignee: The Boeing Company, Arlington, VA (US)

( * ) Notice: Subject to any disclaimer, the term of this patent is extended or adjusted under 35 U.S.C. 154(b) by 0 days.

(21) Appl. No.: 18/762,931

(22) Filed: Jul. 3, 2024

(51) Int. Cl.
*C23C 18/16* (2006.01)

(52) U.S. Cl.
CPC ..... *C23C 18/1628* (2013.01); *C23C 18/1676* (2013.01)

(58) Field of Classification Search
None
See application file for complete search history.

(56) References Cited

U.S. PATENT DOCUMENTS

| | | | | |
|---|---|---|---|---|
| 4,592,808 | A | 6/1986 | Doubt | |
| 4,622,917 | A * | 11/1986 | Schramm | C23C 18/1616 118/316 |
| 5,149,411 | A * | 9/1992 | Castle | C25D 21/04 204/239 |
| 6,093,453 | A * | 7/2000 | Ang | C23C 18/1619 427/443.1 |
| 2022/0170161 | A1* | 6/2022 | Im | C23C 18/1628 |

* cited by examiner

*Primary Examiner* — Charles Capozzi
(74) *Attorney, Agent, or Firm* — Walters & Wasylyna LLC

(57) ABSTRACT

An electroless plating system including an electroless plating solution, a recirculation subsystem and a replenishment subsystem, wherein the electroless plating solution is recirculated and replenished.

20 Claims, 10 Drawing Sheets

ELECTROLESS PLATING SYSTEMS AND METHODS

FIELD

The present disclosure generally relates to electroless plating systems and methods for electroless plating.

BACKGROUND

Conventional electroless plating processes face significant challenges, particularly with premature plating. This issue occurs when the plating reactions initiate before the plating chemicals are even introduced to a plating vessel, leading to unwanted deposition of metal on surfaces and components outside the intended plating area. This not only wastes valuable materials but also contaminates equipment and complicates the plating process. This results in substantial downtime for maintenance to remove and clean the built-up plating on upstream components. These cleaning and maintenance processes are labor-intensive and time-consuming, reducing overall efficiency and increasing operational costs. Addressing these issues is desired for improving the reliability and efficiency of electroless plating systems.

Conventional electroless plating systems pose additional challenges stemming from an uneven chemical concentration in the electroless plating solution. This uneven concentration gradient, with a higher concentration in the upper bath region and a lower concentration in the lower bath region, causes thicker plating at the top and thinner plating at the bottom of the intended plating surface. Furthermore, the higher concentration of chemicals, particularly the reducing agent, in the upper bath region may cause the chemistry of the system to crash. Thus, maintaining an even concentration throughout the entire electroless plating solution is desired.

SUMMARY

Disclosed are electroless plating systems.

In one example, a disclosed electroless plating system includes a vessel defining an internal volume filled with an electroless plating solution wherein the electroless plating solution includes, but not limited to a solvent, a metal salt, and a reducing agent. The disclosed electroless plating system further includes a recirculation subsystem and a replenishment subsystem wherein the replenishment subsystem may include a replenishment inlet portion at a non-zero angle that introduces a variety of replenishment chemicals including, but not limited to the metal salt and the reducing agent.

Also disclosed are methods for electroless plating.

In one example, a disclosed method for electroless plating includes: immersing an article in an electroless plating solution; recirculating the electroless plating solution by drawing a portion of the electroless plating solution from a upper bath region and directing the portion of the electroless plating solution to a lower bath region; and replenishing the electroless plating solution by introducing a metal salt, a reducing agent, and an inert gas in to an initial replenishment conduit segment of a replenishment conduit network to yield a replenishment mixture, wherein the initial replenishment conduit segment is disposed at a non-zero angle relative to a plane that is coincident with the bath surface.

Other examples of the disclosed electroless plating systems and methods for electroless plating will become apparent from the following detailed description, the accompanying drawings, and the appended claims.

DETAILED DESCRIPTION

Figure 1:
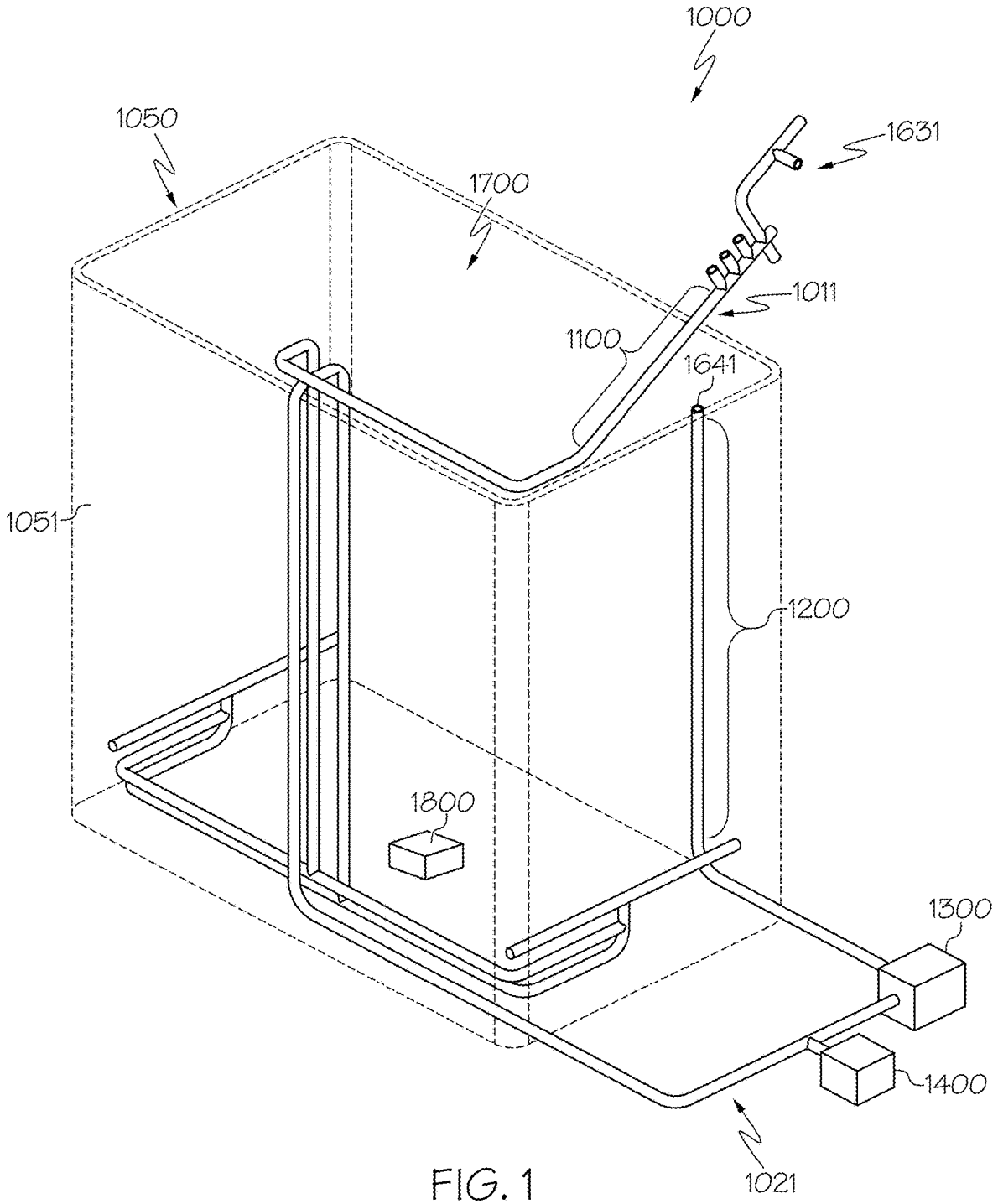
FIG. 1 is an isometric view of one example of the disclosed electroless plating system.

Referring to FIG. 1, one example of the disclosed electroless plating system, generally designated 1000, includes a vessel 1050 defining an internal volume 1700. The vessel 1050 may take many different forms including, but not limited to cubical, cylindrical, and cuboid.

Figure 3:
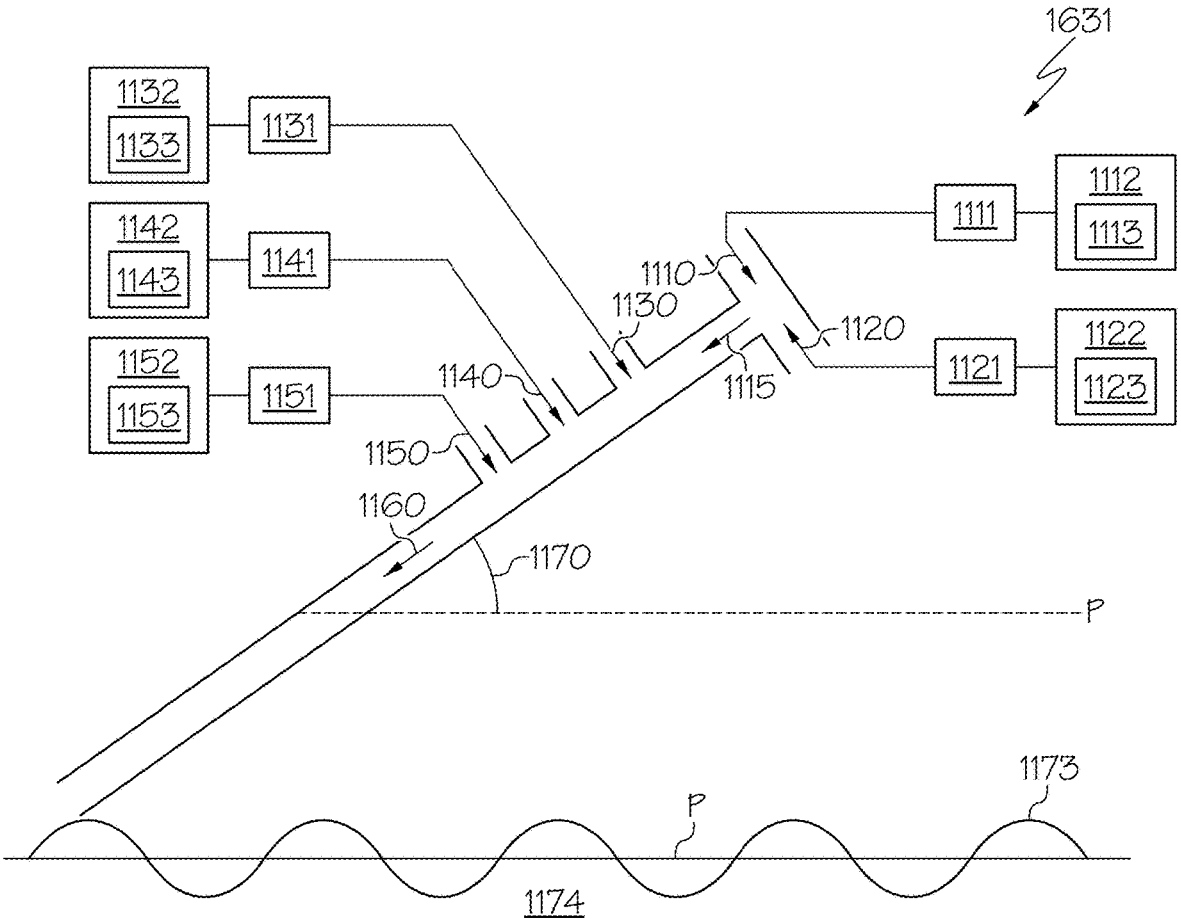
FIG. 3 is a general schematic illustration of the replenishment inlet portion of FIG. 1.
Figure 4:
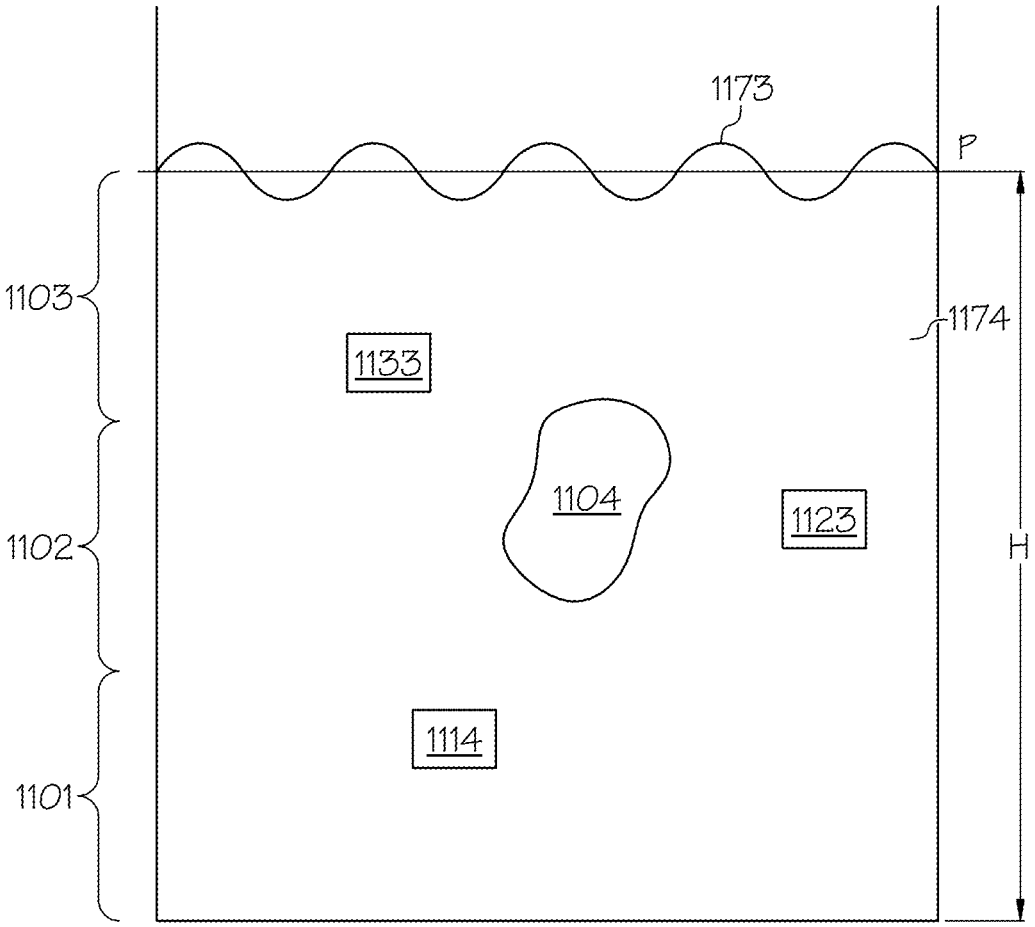
FIG. 4 is a general schematic illustration of the vessel of FIG. 1 depicting different bath regions and one example of the electroless plating solution contents.

Turning to FIGS. 3 and 4, when selecting materials for the vessels 1050 and other internal components that make contacts with the electroless plating solution 1174, several factors must be considered to ensure optimal performance and durability. The materials for the electroless plating system 1000 including the vessel 1050 may be resistant to heated nature and chemicals used during electroless plating including, but not limited to acids for cleaning and maintenance, metal salts 1133, and reducing agents 1123. Those skilled in the art may choose an appropriate material depending on a given project. The appropriate material may include, but not limited to stainless steel, aluminum, aluminum alloy, titanium, polymers, and composite materials.

Referring to FIG. 4, an electroless plating solution 1174 received in the internal volume 1700 may define a bath surface 1173, an upper bath region 1103, a lower bath region 1101, and a middle bath region 1102 between the upper bath region 1103 and the lower bath region 1101. A height H of the electroless plating solution 1174 may vary depending on the size and shape of the vessel 1050.

In one example, the height H may be at least 30 cm. In another example, the height H may be at least 40 cm. In another example, the height H may be at least 50 cm. In another example, the height H may be at least 60 cm. In another example, the height H may be at least 70 cm. In another example, the height H may be at least 80 cm. In another example, the height H may be at least 90 cm. In another example, the height H may be at least 100 cm. In another example, the height H may be at least 120 cm. In another example, the height H may be at least 140 cm. In another example, the height H may be at least 160 cm. In another example, the height H may be at least 180 cm. In another example, the height H may be at least 2 meters. In another example, the height H may be at least 3 meters. In another example, the height H may be at least 3.5 meters. In another example, the height H may be at least 4 meters. In another example, the height H may be at least 5 meters. In another example, the height H may be at least 7.5 meters. In another example, the height H may be at least 10 meters. In another example, the height H may be at least 20 meters. In another example, the height H may be at least 30 meters.

Depending on the article 1104 that needs to be plated, the size of the vessel 1050 may vary. In one example, the article 1104 may be as small as a nut and bolt, in which case the internal volume 1700 of the vessel 1050 may only need to be equally small. In another example, the article 1104 may be a large portion of a wing of an air-plane, in which case the internal volume 1700 of the vessel 1050 may need to be very large.

In one example, the internal volume 1700 may be at least 1 liter. In another example, the internal volume 1700 may be at least 5 liters. In another example, the internal volume 1700 may be at least 10 liters. In another example, the internal volume 1700 may be at least 50 liters. In another example, the internal volume 1700 may be at least 100 liters. In another example, the internal volume 1700 may be at least 150 liters. In another example, the internal volume 1700 may be at least 200 liters. In another example, the internal volume 1700 may be at least 300 liters. In another example, the internal volume 1700 may be at least 400 liters. In another example, the internal volume 1700 may be at least 500 liters. In another example, the internal volume 1700 may be at least 700 liters. In another example, the internal volume 1700 may be at least 1000 liters.

Figure 8B:
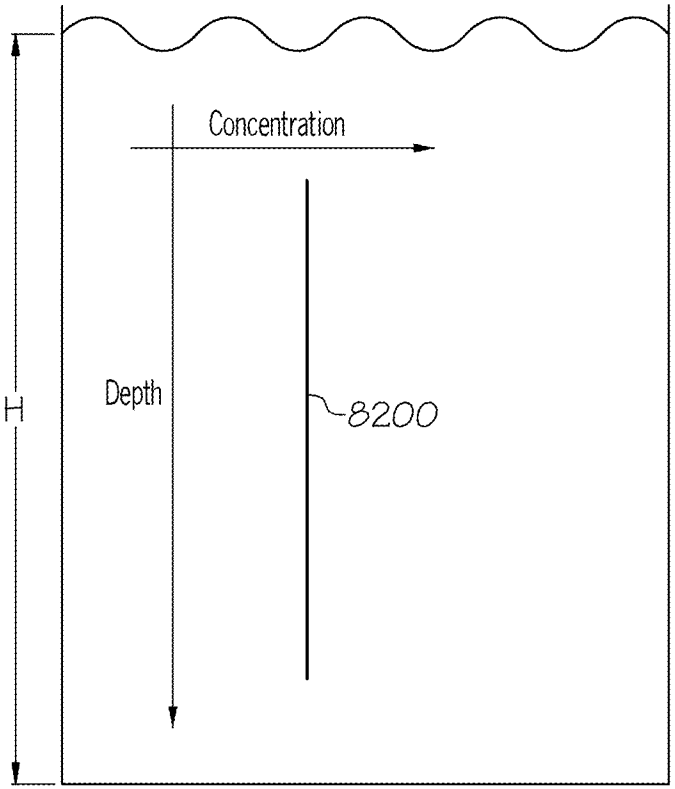
FIG. 8B is a graph showing concentration gradient after introducing a portion of the electroless plating solution from the upper bath region to the lower bath region.
Figure 8A:
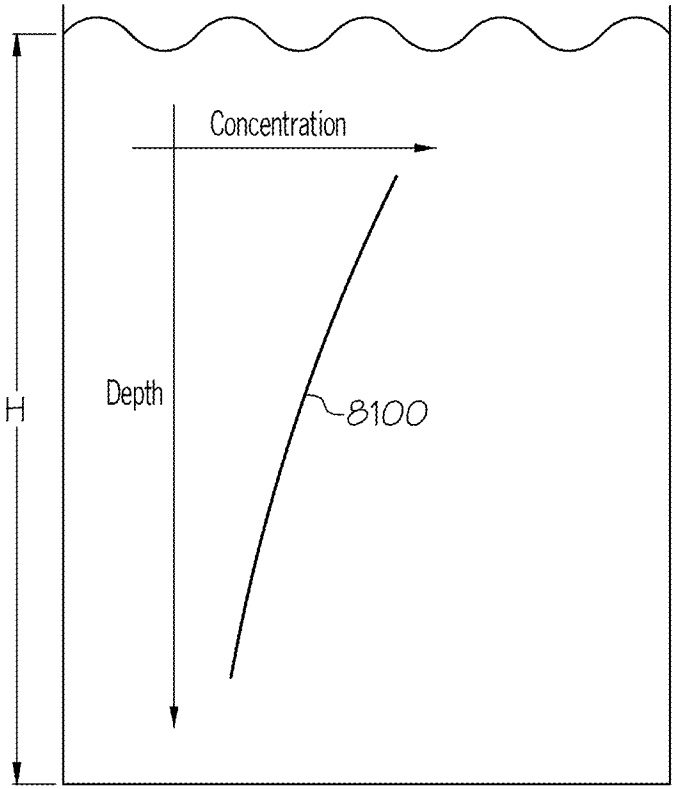
FIG. 8A is a graph showing concentration gradient before introducing a portion of the electroless plating solution from the upper bath region to the lower bath region.
Figure 9B:
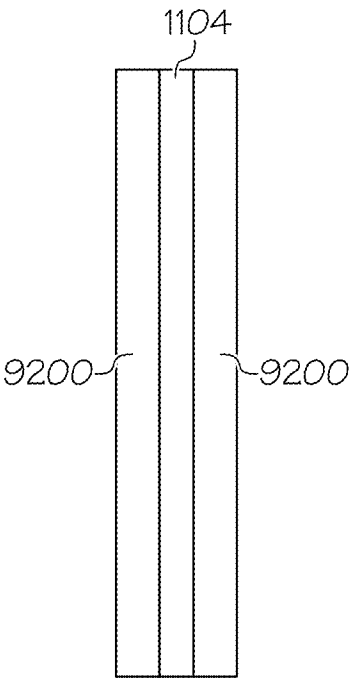
FIG. 9B is a FIG. 9A is a cross-sectional view of an electroless plated article depicting relatively uniform plating thickness.
Figure 9A:
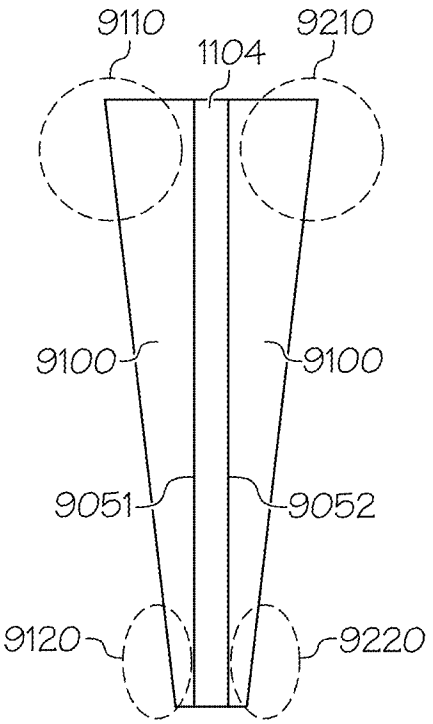
FIG. 9A is a cross-sectional view of an electroless plated article depicting varying plating thickness.

Referring to FIGS. 8A, 8B and 9A, conventional electroless plating systems may pose challenges stemming from an uneven concentration gradient 8100 of the electroless plating solution 1174. This uneven concentration gradient 8100, with a higher concentration at an upper bath region 1103 and a lower concentration at a lower bath region 1101, causes an uneven plating 9100 with thicker plating 9110, 9210 at the top and a thinner plating 9120, 9220 at the bottom of intended plating surfaces 9051, 9052. Furthermore, the higher concentration of chemicals, particularly the reducing agent 1123, at the upper bath region 1103 may cause the tank chemistry to crash. Thus, it is desired to maintain a relatively even concentration 8200 throughout the entire electroless plating solution 1174.

Figure 2A:
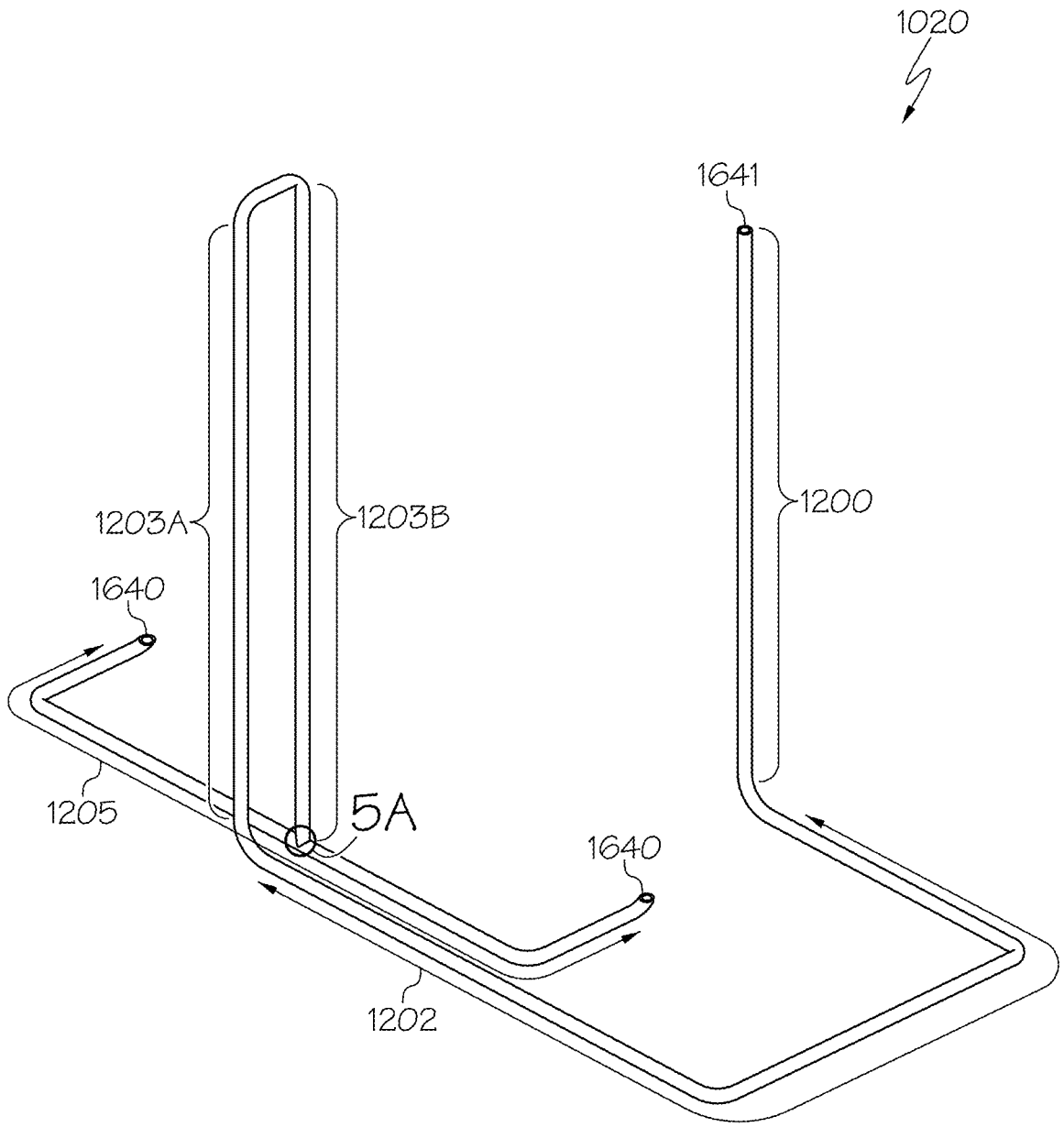
FIG. 2A is an isometric view of the recirculation subsystem of FIG. 1.
Figure 7:
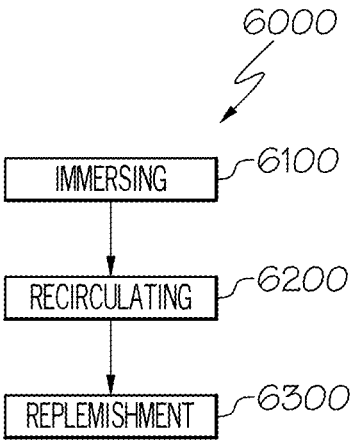
FIG. 7 is a flow diagram depicting one example of the disclosed method for electroless plating.

Turning to FIG. 7, this uneven concentration gradient 8100 challenge may be overcome by recirculating 6200 the electroless plating solution 1174. The effectiveness of the recirculating 6200 the electroless plating solution 1174 may vary depending on the location of a recirculation inlet portion 1641 (FIGS. 1 and 2A) and the location of a recirculation outlet portion 1640 (FIG. 2A). In one example, the recirculation inlet portion 1641 may be disposed within the upper bath region 1103. In another example, the recirculation inlet portion 1641 may be disposed within a middle bath region 1102. In another example, the recirculation outlet portion 1640 may be disposed within the middle bath region 1102. In another example, the recirculation outlet portion 1640 may be disposed within the lower bath region 1101.

In another example, a portion of the electroless plating solution 1174 from the upper bath region 1103 may be directed to lower bath region 1101. In another example, a portion of the electroless plating solution 1174 from the upper bath region 1103 may be directed to the middle bath region 1102. In another example, a portion of the electroless plating solution 1174 from the middle bath region 1102 may be directed to the lower bath region 1101.

The area that each region 1101, 1102, 1103 covers may vary depending on a given project. Those skilled in the art may choose the coverage range. In one example, the upper bath region 1103 extends from about 60 percent of the height H to about 100 percent of the height H. In another example, the upper bath region 1103 extends from about 70 percent of the height H to about 100 percent of the height H. In another example, the upper bath region 1103 extends from about 80 percent of the height H to about 100 percent of the height H.

In another example, the lower bath region 1101 extends from about 0 percent of the height H to about 40 percent of the height H. In another example, the lower bath region 1101 extends from about 0 percent of the height H to about 30 percent of the height H. In another example, the lower bath region 1101 extends from about 0 percent of the height H to about 20 percent of the height H.

Referring again to FIG. 4, the electroless plating solution 1174 may be an aqueous mixture of chemicals including, but not limited to a solvent 1114, a metal salt 1133, and a reducing agent 1123. In one example, the solvent 1114 may be water. In another example, the metal salt 1133 may be at least one of nickel sulfate and nickel chloride. In another example, the reducing agent 1123 may be sodium hypophosphite.

Figure 2B:
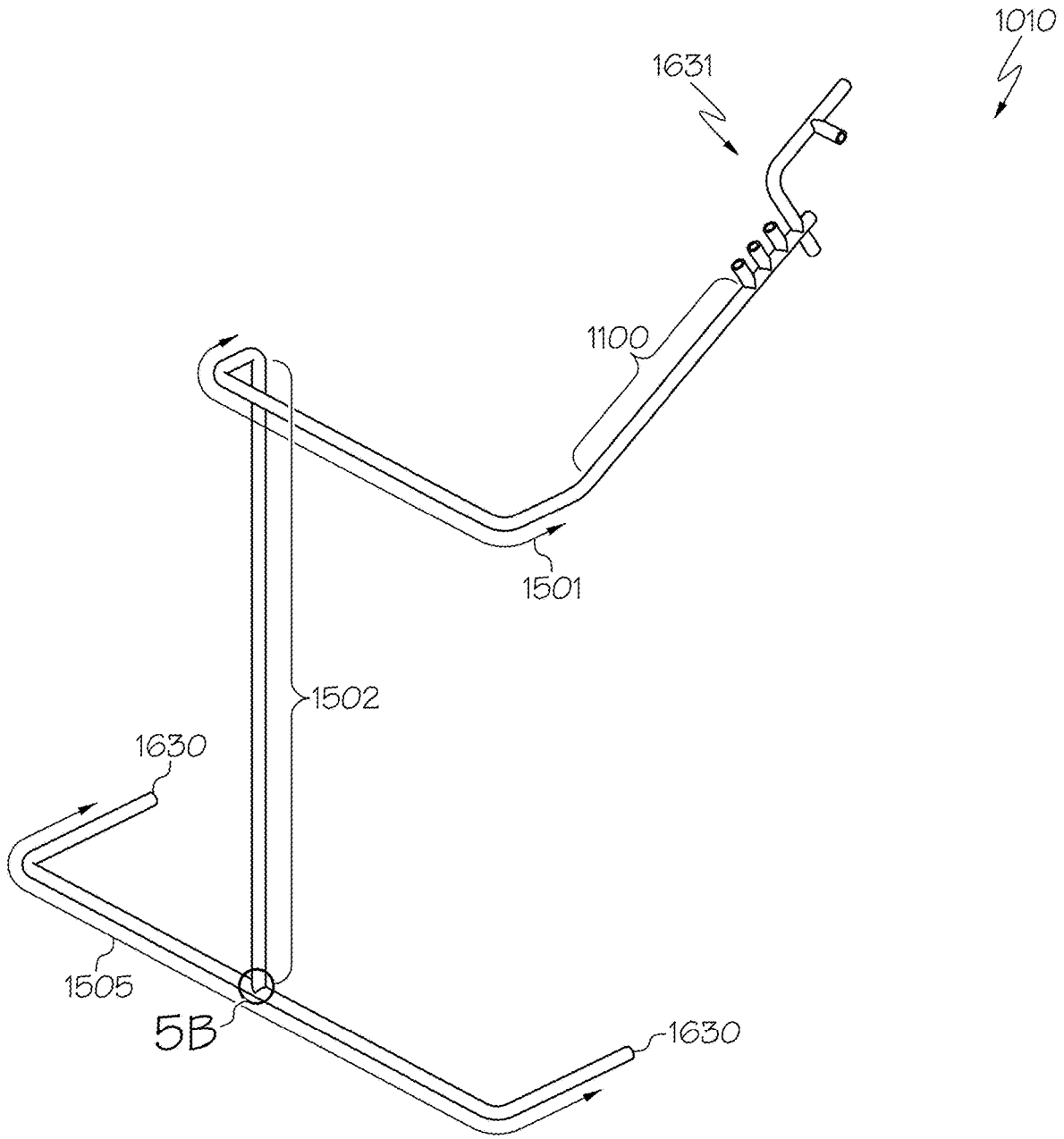
FIG. 2B is an isometric view of the replenishment subsystem of FIG. 1.

Referring to FIGS. 1 and 2, one example of the disclosed electroless plating system 1000 may further include a recirculation subsystem 1020 (FIG. 2A) and a replenishment subsystem 1010 (FIG. 2B). These subsystems 1020, 1010 may be the key in solving issues that current conventional electroless plating systems present. In one example, the recirculation subsystem 1020 may help resolving the uneven concentration gradient 8100 issue of the electroless plating solution 1174. In another example, the replenishment subsystem 1010 may help both the uneven concentration gradient 8100 issue of the electroless plating solution 1174 and the premature plating issue by introducing precise amount of each relevant chemicals separately at a predetermined time.

In one particular construction as shown in FIG. 1, a recirculation subsystem 1020 may include, but not limited to a pump 1300 and a recirculation conduit network 1021 at least partially immersed in the electroless plating solution 1174. The recirculation conduit network 1021 may include a recirculation inlet portion 1641 in fluid communication with a recirculation outlet portion 1640 (FIG. 2A), wherein the recirculation inlet portion 1641 may be disposed within at least one of the upper bath region 1103 and the middle bath region 1102, wherein the recirculation outlet portion 1640 may be disposed within at least one of the middle bath region 1102 and the lower bath region 1101, and wherein the pump 1300 may be positioned to move the electroless plating solution 1174 from the recirculation inlet portion 1641 to the recirculation outlet portion 1640. The overall configuration of the recirculation conduit network 1021 may vary depending on a given project.

In one example as shown in FIG. 2A, the recirculation conduit network 1021 of the recirculation subsystem 1020 may further include, but not limited to an initial recirculation conduit segment 1200, a first horizontal recirculation portion 1202, a second vertical recirculation portion 1203A, and a third vertical recirculation portion 1203B. After entering the recirculation conduit network 1021 through the recirculation inlet portion 1641, a portion of the electroless plating solution 1174 from the upper bath region 1103 may go through the initial recirculation conduit segment 1200 that defines the recirculation inlet portion 1641.

In another example, the initial recirculation conduit segment 1200 of the recirculation conduit network 1021 may be vertically immersed in the electroless plating solution 1174, as shown in FIG. 1. In another example, the initial recirculation conduit segment 1200 of the recirculation conduit network 1021 may guide the portion of the electroless plating solution 1174 from the upper bath region 1103 upward out of the electroless plating solution 1174, over a wall 1051, and downward to the lower bath region. In other words, as long as the recirculation subsystem 1020 directs the portion of the electroless plating solution 1174 from the upper bath region 1103 to the lower bath region, the purpose of the recirculation subsystem 1020 may be satisfied. Thus, a proper configuration of the recirculation conduit network 1021 of the recirculation subsystem 1020 is desired.

Referring again to FIG. 2A, the second vertical recirculation portion 1203A may be fluidly coupled with the initial recirculation conduit segment 1200 through the first horizontal recirculation portion 1202 and may be configured to move the portion the electroless plating solution 1174 from the upper bath region 1103 vertically upward over a wall 1051 of a vessel 1050. The third vertical recirculation portion 1203B that is fluidly coupled with the second vertical recirculation portion 1203A and the recirculation outlet portion 1640 may be configured to move the portion of electroless plating solution 1174 from the upper bath region 1103 vertically downward to the lower bath region 1101.

Figure 5A:
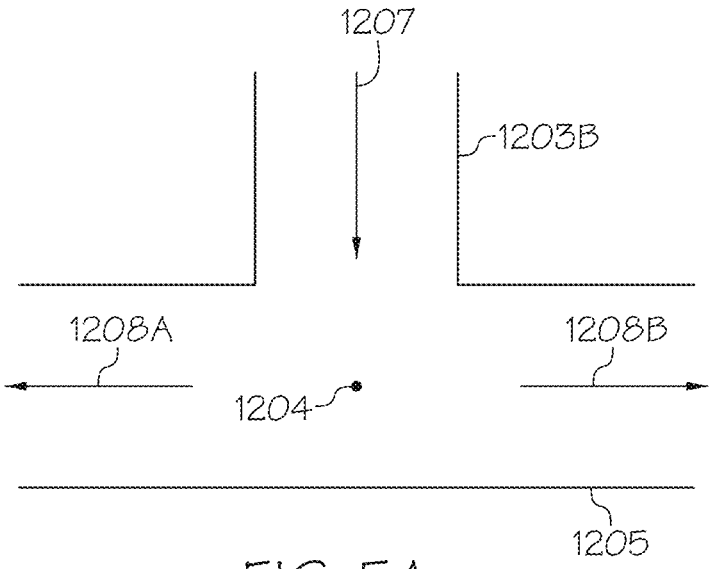
FIG. 5A is a general schematic illustration of the junction area of the recirculation conduit network of FIG. 1.

Once the portion of the electroless plating solution 1174 from the upper bath region 1103 reaches the lower bath region 1101, it may be released into the electroless plating solution 1174 in the vessel 1050 through a recirculation outlet portion 1640. However, for more even distribution and efficiency, an initial recirculation flow 1207 of the electroless plating solution 1174 from the upper bath region 1103 may be divided into a plurality of divided recirculation flows 1208A, 1208B (FIG. 5A). As shown in FIGS. 2A and 5A, the recirculation conduit network 1021 may further include a recirculation diverging junction 1204 that divides an initial recirculation flow 1207 from the third vertical recirculation portion 1203B into at least two divided recirculation flows 1208A, 1208B. In the current example, the initial recirculation flow 1207 may be divided into two divided recirculation flows 1208A, 1208B.

Referring again to FIG. 2A, for more even distribution, the recirculation conduit network 1021 may further include a second horizontal recirculation portion 1205 that is fluidly coupled with the third vertical recirculation portion 1203B at the recirculation diverging junction 1204 and defines a plurality of recirculation outlet portions 1640. The divided recirculation flows 1208A, 1208B may travel through the second horizontal portion 1205 and may be released into the electroless plating solution 1174 in the vessel 1050 at different parts of the lower bath region 1101 where the plurality of recirculation outlet portions 1640 are disposed.

Generally, an electroless plating system 1000 depletes certain chemicals including, but not limited to a metal salt 1133 and a reducing agent 1123 within an electroless plating solution 1174 in a vessel 1050 while the electroless plating system 1000 is running. In other words, those used chemicals during the process may need to be replenished to maintain the overall chemical balance of the electroless plating solution 1174 in the vessel 1050 of the electroless plating system 1000. Because the reducing agent 1123 is the main trigger of the electroless plating process, to reduce premature plating, it is desired to minimize the time between mixing the reducing agent 1123 with other chemicals, creating a replenishment mixture 1160, and introducing that replenishment mixture 1160 into the electroless plating solution 1174 in the vessel 1050.

In one particular construction as shown in FIGS. 1, 2B, and 3, a replenishment subsystem 1010 may include a replenishment conduit network 1011, a bulk supply 1132 of the metal salt 1133, a bulk supply 1122 of the reducing agent 1123, and a bulk supply 1112 of an inert gas 1113. The replenishment conduit network 1011 may include a replenishment inlet portion 1631 that is in fluid communication with a replenishment outlet portion 1630 disposed within at least one of the middle bath region 1102 and the lower bath region 1101. The replenishment conduit network 1011 may further include an initial replenishment conduit segment 1100 that defines the replenishment inlet portion 1631 disposed at a non-zero angle 1170 relative to a plane P that is coincident with a bath surface 1173 of the electroless plating solution 1174, wherein the bulk supply 1132 of the metal salt 1133, the bulk supply 1122 of the reducing agent 1123, and the bulk supply 1112 of the inert gas 1113 are in selective fluid communication with the replenishment inlet portion 1631 of the replenishment conduit network 1011.

Still referring to the particular construction above, the replenishment conduit network 1011 of the replenishment subsystem 1010 may further include a first horizontal replenishment portion 1501 that is fluidly coupled with the initial replenishment conduit segment 1100 and a vertical replenishment portion 1502, wherein the vertical replenishment portion 1502 that is fluidly coupled with the initial replenishment conduit segment 1100, the vertical replenishment portion 1502 being configured to move a replenishment mixture 1160 vertically downward to the lower bath region 1101, and the vertical replenishment portion 1502 that is in fluid communication with the replenishment outlet portion 1630.

Figure 5B:
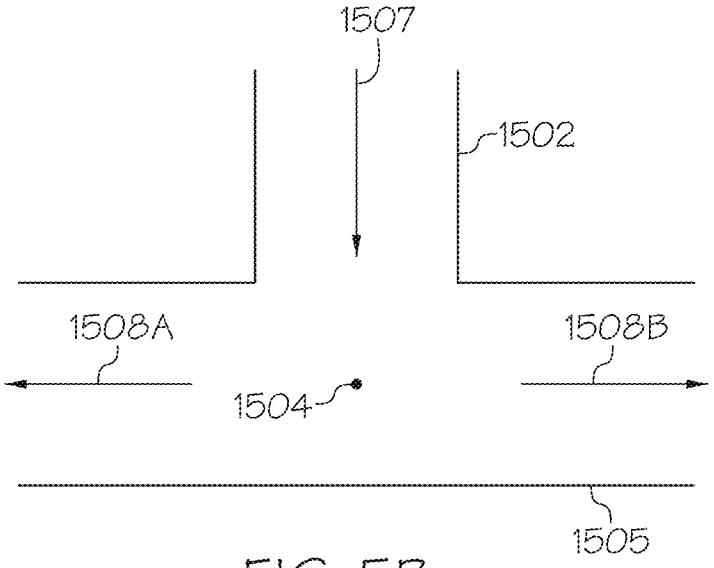
FIG. 5B is a general schematic illustration of the junction area of the replenishment conduit network of FIG. 1.

Once the replenishment mixture 1160 reaches the lower bath region 1101, it may be released into the electroless plating solution 1174 in the vessel 1050. Referring to FIGS. 1, 2B and 5B, to facilitate more even distribution of the replenishment mixture 1160, the replenishment conduit network 1011 of the replenishment subsystem 1010 may further include a replenishment diverging junction 1504 at the end of the vertical replenishment portion 1502. An initial replenishment flow 1507 from the vertical replenishment portion 1502 may be divided into at least two divided replenishment flows 1508A, 1508B at the replenishment diverging junction 1504. These divided replenishment flows 1508A, 1508B may travel through a second horizontal replenishment portion 1505 that is fluidly coupled with the vertical replenishment portion 1502 at the replenishment diverging junction 1504 and defines the replenishment outlet portion 1630.

Those skilled in the art may need to choose the value of the non-zero angle 1170 carefully because it provides gravitational force and ensures sequential injection of different chemicals into the replenishment subsystem 1010. In one example, the non-zero angle 1170 may be between about 5 degrees and about 90 degrees. In another example, the non-zero angle 1170 may be between about 5 degrees and about 70 degrees. In another example, the non-zero angle 1170 may be between about 10 degrees and about 60 degrees. In another example, the non-zero angle 1170 may be between about 10 degrees and about 50 degrees. In another example, the non-zero angle 1170 may be between about 15 degrees and about 45 degrees. In another example, the non-zero angle 1170 may be between about 20 degrees and about 40 degrees.

In another example, the non-zero angle 1170 may be at least 10 degrees. In another example, the non-zero angle 1170 may be at least 15 degrees. In another example, the non-zero angle 1170 may be at least 20 degrees. In another example, the non-zero angle 1170 may be at least 25 degrees. In another example, the non-zero angle 1170 may be at least 30 degrees. In another example, the non-zero angle 1170 may be at least 35 degrees. In another example, the non-zero angle 1170 may be at least 40 degrees. In another example, the non-zero angle 1170 may be at least 45 degrees. In another example, the non-zero angle 1170 may be at least 50 degrees. In another example, the non-zero angle 1170 may be at least 60 degrees. In another example, the non-zero angle 1170 may be at least 70 degrees. In another example, the non-zero angle 1170 may be at least 80 degrees. In another example, the non-zero angle 1170 may be about 90 degrees.

The electroless plating solution 1174 may involve more than one metal salt 1133 for a given project and this may require introducing more than one replenishment metal salts 1133, 1143, 1153. In one example, there may be at least one bulk supply 1132 of the metal salt 1133. In another example, there may be at least two bulk supplies 1132, 1142 of metal salts 1133 1143. In another example, there may be at least three bulk supplies 1132, 1142, 1152 of metal salts 1133 1143, 1153.

The electroless plating system 1000 is very sensitive and just a slight change in its chemical balance may result in total collapse of the system. This is why it is very desired to replenish just the right amount of chemicals at the replenishment inlet portion 1631. In one example, the right amount of any replenishment chemical may be released by a displacement pump. As shown in FIG. 3, replenishment chemical flows 1120, 1130, 1140, 1150 may be precisely controlled and released by displacement pumps 1121, 1131, 1141, 1151 disposed between the corresponding bulk supplies 1122, 1132, 1142, 1152 and the replenishment inlet portion 1631 of the replenishment conduit network 1011. These displacement pumps 1121, 1131, 1141, 1151 provide selective fluid communication between bulk supplies 1122, 1132, 1142, 1152 and the replenishment inlet portion 1631 of the replenishment conduit network 1011.

In one example, a first metal salt displacement pump 1131 is disposed in between the bulk supply 1132 of the metal salt 1133 and the replenishment inlet portion 1631 of the replenishment conduit network 1011 for a metered release. In another example, a second metal salt displacement pump 1141 is disposed in between the bulk supply 1142 of a second metal salt 1143 and the replenishment inlet portion 1631 of the replenishment conduit network 1011 for a metered release. In another example a third metal salt displacement pump 1151 is disposed in between the bulk supply 1152 of a third metal salt 1153 and the replenishment inlet portion 1631 of the replenishment conduit network 1011 for a metered release. In another example, a reducing agent displacement pump 1121 is disposed in between the bulk supply 1122 of the reducing agent 1123 and the replenishment inlet portion 1631 of the replenishment conduit network 1011 for a metered release.

As mentioned earlier, to reduce premature plating, it is desired to minimize the time between mixing the reducing agent 1123 with other chemicals including, but not limited to an inert gas 1113 and metal salts 1133, 1143, 1153, creating a replenishment mixture 1160, and introducing that replenishment mixture 1160 into the electroless plating solution 1174 in the vessel 1050. One way of reducing this time is by making the replenishment mixture 1160 travel faster using a pressurized inert gas 1113 that includes, but not limited to nitrogen. The inert nature of the inert gas may reduce premature plating. A pressure regulator 1111 may be disposed between the bulk supply 1112 of the inert gas 1113 and the replenishment inlet portion 1631 of the replenishment conduit network 1011.

As much as a proper configuration of the inlet portions 1631, 1641 of the subsystems 1010, 1020 is desired for maintaining the chemical balance of the electroless plating system 1000, a proper configuration of the outlet portions 1630, 1640 of the subsystems 1010, 1020 is equally desired. Proper configurations of these outlet portions 1630, 1640 ensure efficient operation and help to prevent issues that could otherwise disrupt the chemical balance, contributing to the overall effectiveness and longevity of the electroless plating system 1000.

Those skilled in the art may choose proper configurations of the outlet portions 1630, 1640 depending on the specifics of a given project. In one example, referring to FIGS. 5A, 5B, and 6, the recirculation outlet portion 1640 and the replenishment outlet portion 1630 may be placed separately at different locations. In other words, each of the divided recirculation flows 1208A, 1208B and the divided replenishment flows 1508A, 1508B are individually and separately introduced into the electroless plating solution 1174 in the vessel 1050.

Figure 6:
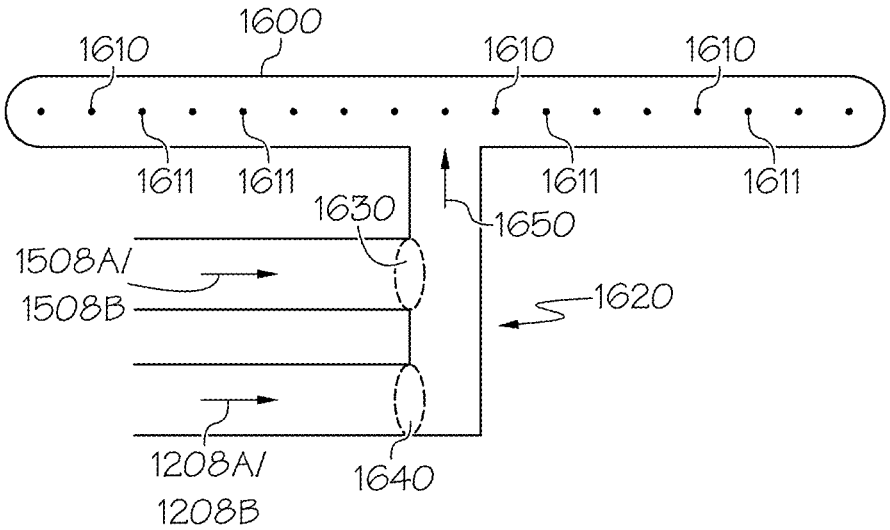
FIG. 6 is a general schematic illustration of the outlet area of FIG. 1.

In another example, referring to FIGS. 5A, 5B, and 6, one of the divided recirculation flows 1208A, 1208B and one of the divided replenishment flows 1508A, 1508B may merge into a unified flow 1650 at an outlet merging junction 1620. This unified flow 1650 may be released into the electroless plating solution 1174 in the vessel 1050. For a better-distributed release, those skilled in the art may choose to use various release features 1690, including but not limited to spargers 1600 with a plurality of sparger holes 1610, wherein each sparger hole 1610 represents a point of release 1611. The larger the spargers 1600 and the greater the number of sparger holes 1610, the more effectively the release is distributed.

In one example, the release feature 1690 may have at least 1 point of release 1611. In another example, the release feature 1690 may have at least 10 points of release 1611. In another example, the release feature 1690 may have at least 30 points of release 1611. In another example, the release feature 1690 may have at least 50 points of release 1611. In another example, the release feature 1690 may have at least 100 points of release 1611. In another example, the release feature 1690 may have at least 200 points of release 1611. In another example, the release feature 1690 may have at least 300 points of release 1611.

The electroless plating system 1000 may further include at least one heater 1800 (FIG. 1), as it may require an elevated temperature of the electroless plating solution 1174. Those skilled in the art may choose the exact type and location of the heater 1800, as each project may require different specifications of the heater 1800. In one example, the heater 1800 may be placed at the bottom of the vessel 1050. In another example, the heater 1800 may be placed on the wall 1051 of the vessel 1050. In another example, the heater 1800 may be placed within at least one of the subsystems 1010, 1020.

In order to check the status of the chemical balance of the electroless plating solution 1174, the electroless plating system 1000 may require at least one analyzer 1400 that measures various parameters of the electroless plating solution 1174 and replenishment 6300 chemicals. Those parameters may include, but not limited to concentration of the reducing agent 1123 and the metal salt 1133, temperature, and pH level of the electroless plating solution 1174. The information measured by the analyzer 1400 may be used to determine the amount and speed of replenishment 6300 and recirculation 6200. Those skilled in the art may choose the location of the analyzer 1400 and how often they want to measure based on a given project. In one example, the analyzer 1400 may be placed at the bottom of the vessel 1050. In another example, the analyzer 1400 may be placed on the wall 1051 of the vessel 1050. In another example, the analyzer 1400 may be placed within at least one of the subsystems 1010, 1020. In another example, there may be several more than one analyzer 1400 at different locations. In another example, there may be at least two analyzers 1400 along the depth of the electroless plating solution 1174 that can measure the concentration gradients 8100, 8200.

For the interval of the measurement, the analyzer 1400 may continuously monitor the parameters of the electroless plating solution 1174. In another example, the analyzer 1400 may measure the parameters of the electroless plating solution 1174 at specific intervals. In another example, the analyzer 1400 may measure the parameters of the electroless plating solution 1174 at an interval of at least 0.05 seconds. In another example, the analyzer 1400 may measure the parameters of the electroless plating solution 1174 at an interval of at least 0.1 seconds. In another example, the analyzer 1400 may measure the parameters of the electroless plating solution 1174 at an interval of at least 0.5 seconds. In another example, the analyzer 1400 may measure the parameters of the electroless plating solution 1174 at an interval of at least 1 second. In another example, the analyzer 1400 may measure the parameters of the electroless plating solution 1174 at an interval of at least 2 seconds. In another example, the analyzer 1400 may measure the parameters of the electroless plating solution 1174 at an interval of at least 3 seconds. In another example, the analyzer 1400 may measure the parameters of the electroless plating solution 1174 at an interval of at least 5 seconds. In another example, the analyzer 1400 may measure the parameters of the electroless plating solution 1174 at an interval of at least 0.05 10 seconds.

Figure 10:
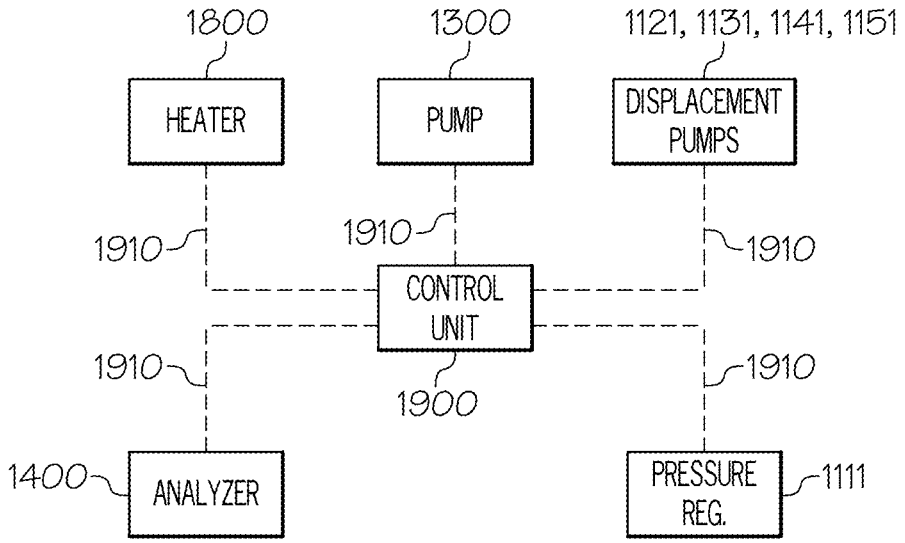
FIG. 10 is a general schematic diagram of a control unit in communication with the disclosed electroless plating system.

Referring to FIG. 10, the electroless plating system 1000 may further need a control unit 1900 that is in communication 1910 with all the relevant components including, but not limited to the analyzer 1400, the heater 1800, the recirculation pump 1300, displacement pumps 1121, 1131, 1141, 1151, and the pressure regulator 1111. These communications 1910 may be in various formats, including but not limited to wired and wireless. Additionally, these communications 1910 between the control unit 1900 and the relevant components may be either one-way, where information is only transmitted in a single direction, or two-way, allowing for an interactive exchange of data. In one example, the information gathered by the analyzer 1400 may be sent to the control unit, and the control unit may be programmed by those skilled in the art to send a command to one of the displacement pumps 1121, 1131, 1141, 1151 to make a controlled, metered release of a depleted chemical based on the information from the analyzer 1400. In another example, the control unit 1900 may control the heater 1800 to increase or decrease the temperature of the electroless plating solution 1174.

Referring now to FIG. 7, disclosed is an example of a method 6000 for electroless plating that utilizes a recirculation subsystem 1020 and a replenishment subsystem 1010. The method 6000 includes, but not limited to: immersing 6100 an article 1104 in an electroless plating solution 1174; recirculating 6200 the electroless plating solution 1174 by drawing a portion of the electroless plating solution 1174 from at least one of the upper bath region 1103 and the middle bath region 1102, and directing the portion of the electroless plating solution 1174 to at least one of the middle bath region 1102 and the lower bath region 1101; and replenishing 6300 the electroless plating solution 1174 by introducing depleted chemicals including but not limited to a metal salt 1133, a reducing agent 1123, and an inert gas 1113 into an initial replenishment conduit segment 1100 of a replenishment conduit network 1011 to yield a replenishment mixture 1160, wherein the replenishment conduit network 1011 directs the replenishment mixture 1160 to at least one of the middle bath region 1102 and the lower bath region 1101.

Immersing 6100 the article 1104 into the electroless plating solution 1174 requires careful attention to ensure optimal results. Before the immersing 6100 step, the article 1104 must be thoroughly cleaned and free of contaminants to allow for proper adhesion of the plating material. The article 1104 may be immersed using various ways including, but not limited to a support structure and a hanger that ensures full submersion. The immersing 6100 step may be conducted at a controlled and steady pace to avoid introducing air bubbles or causing agitation that might disturb the balance of the electroless plating solution 1174. Those skilled in the art may choose an appropriate pace based on the specifics of a given project.

Proper positioning of the article 1104 within the electroless plating solution 1174 is desired to achieve a uniform plating 9200. In one example, the article 1104 may be placed in the upper bath region 1103. In another example, the article 1104 may be placed in the middle bath region 1102. In another example, the article 1104 may be placed in the lower bath region 1101. In another example, the article 1104 may be placed across different regions 1101, 1102, 1103. Those skilled in the art may choose an appropriate position based on the specifics of a given project.

The electrolessly plating method 6000 is a highly sensitive and unstable chemical process that demands meticulous control and precision. Unlike traditional electroplating, which relies on an external electrical power source, electroless plating relies on a chemical reduction reaction to deposit a metal layer on a substrate. This reaction is highly susceptible to variations in chemical balances including, but not limited to metal salt concentrations and reducing agent concentrations, temperature, and PH levels. Even minor fluctuations can lead to an uneven plating 9100, poor adhesion, and unexpected deposition rates. Thus, the electrolessly plating method 6000 requires constant monitoring and precise management of the chemical balance of the electroless plating solution to prevent issues including, but not limited to premature plating, solution instability, and chemistry crashes.

Referring to FIGS. 8A and 9A, an uneven concentration gradient 8100 of chemicals, including but not limited to metal salts 1133, 1143, 1153 and the reducing agent 1123 in the electroless plating solution 1174, is likely to yield an uneven plating 9100. Through the method 6000 that involves the recirculating 6200 step, it may be possible to achieve a relatively even concentration gradient 8200 as shown in FIG. 8B which in turn would yield a relatively more uniform plating 9200 as shown in FIG. 9B.

To minimize the uneven concentration gradient 8100, the disclosed method 6000 may involve various steps of mixing the electroless plating solution 1174 including, but not limited to recirculating 6200 by taking a portion of the electroless plating solution 1174 from the upper bath region 1103 and introducing it back down to the lower bath region 1101. In one example, by performing the recirculating 6200 step, the electroless plating solution 1174 with a higher concentration of reducing agent 1123 mixes with the electroless plating solution 1174 with a lower concentration of reducing agent 1123. Those skilled in the art may choose the rate at which the recirculating 6200 is performed based on the specifics of a given project.

The method 6000 for electrolessly plating inherently results in the depletion of certain chemicals, including but not limited to metal salts 1133, 1143, 1153 and the reducing agent 1123, within the electroless plating solution 1174 contained in a vessel 1050. This depletion occurs continuously while the system is running. To maintain an overall chemical balance of the electroless plating solution 1174, it is essential to replenish these consumed chemicals. The manner in which the replenishment 6300 chemicals, including but not limited to metal salts 1133, 1143, 1153 and the reducing agent 1123, are introduced affects premature plating and thus plays a key role in determining the life cycle of the electroless plating system 1000. Therefore, it is desired to find a proper method of replenishment that does not interrupt the electroless plating system 1000 while introducing just the right amount of replenishment mixtures 1160 at the right time and at the right rate.

In one example, the method 6000 may involve a replenishment 6300 step to replenish the consumed reducing agent 1123 and metal salts 1133, 1143, 1153. Referring to FIGS. 1 and 3, each replenishment 6300 chemicals may be introduced through a replenishment inlet portion 1631 individually and sequentially as a replenishment reducing agent flow 1120 and replenishment metal salt flows 1130, 1140, 1150. As illustrated in FIG. 3, a pressurized inert gas flow 1110 first merges with the replenishment reducing agent flow 1120, forming a first replenishment mixture 1115. In this example, the first replenishment mixture starts to travel through an initial replenishment conduit segment 1100 disposed at a non-zero angle 1170 relative to a plane P that is coincident with a bath surface 1173. As the first replenishment mixture travels, at least one replenishment chemicals, including but not limited to the replenishment metal salt flows 1130, 1140, 1150, may be injected sequentially one by one, eventually forming a replenishment mixture 1160. After traveling through the replenishment conduit network 1011, the replenishment mixture 1160 may be released into the electroless plating solution 1174 in the vessel 1050 through a replenishment outlet portion 1630. This inert gas propelled replenishment 6300 may reduce the uneven concentration gradient 8100 and premature plating on unintended surfaces and components before getting introduced to the electroless plating solution 1174 in the vessel 1050.

Those skilled in the art may choose to introduce the replenishment mixture 1160 at an appropriate value of the non-zero angle 1170 depending on a given project. In one example, the non-zero angle 1170 may be between about 5 degrees and about 90 degrees. In another example, the non-zero angle 1170 may be between about 5 degrees and about 70 degrees. In another example, the non-zero angle 1170 may be between about 10 degrees and about 60 degrees. In another example, the non-zero angle 1170 may be between about 10 degrees and about 50 degrees. In another example, the non-zero angle 1170 may be between about 15 degrees and about 45 degrees. In another example, the non-zero angle 1170 may be between about 20 degrees and about 40 degrees.

In another example, the non-zero angle 1170 may be at least 10 degrees. In another example, the non-zero angle 1170 may be at least 15 degrees. In another example, the non-zero angle 1170 may be at least 20 degrees. In another example, the non-zero angle 1170 may be at least 25 degrees. In another example, the non-zero angle 1170 may be at least 30 degrees. In another example, the non-zero angle 1170 may be at least 35 degrees. In another example, the non-zero angle 1170 may be at least 40 degrees. In another example, the non-zero angle 1170 may be at least 45 degrees. In another example, the non-zero angle 1170 may be at least 50 degrees. In another example, the non-zero angle 1170 may be at least 60 degrees. In another example, the non-zero angle 1170 may be at least 70 degrees. In another example, the non-zero angle 1170 may be at least 80 degrees. In another example, the non-zero angle 1170 may be about 90 degrees.

As much as a proper configuration of the inlet portions 1631, 1641 of the subsystems 1010, 1020 is desired for maintaining the chemical balance of the electroless plating system 1000, a proper configuration of the outlet portions 1630, 1640 of the subsystems 1010, 1020 is equally desired. Proper release through these outlet portions 1630, 1640 ensure efficient operation and help to prevent issues that could otherwise disrupt the chemical balance, contributing to the overall effectiveness and longevity of the electroless plating system 1000.

Those skilled in the art may choose a proper method of release through the outlet portions 1630, 1640 depending on the specifics of a given project. In one example, recirculating 6200 flows and replenishment 6300 flows may be introduced to the electroless plating solution 1174 in the vessel 1050 separately at their own rate. In another example, recirculating 6200 flows and replenishment 6300 flows may be introduced to the electroless plating solution 1174 in the vessel 1050 together as a unified flow 1650 as shown in FIG. 6.

In another example, those skilled in the art may choose to use an additional release system including, but not limited to a sparger 1600 with a plurality of holes 1610. Each hole 1610 acts as a point of release 1611. Therefore, the greater the number of sparger holes 1610, the more effectively the release is distributed. In one example, recirculating 6200 flows and replenishment 6300 flows may be introduced to the electroless plating solution 1174 in the vessel 1050 through at least 10 different points of release 1611. In another example, recirculating 6200 flows and replenishment 6300 flows may be introduced to the electroless plating solution 1174 in the vessel 1050 through at least 30 different points of release 1611. In another example, recirculating 6200 flows and replenishment 6300 flows may be introduced to the electroless plating solution 1174 in the vessel 1050 through at least 50 different points of release 1611. In another example, recirculating 6200 flows and replenishment 6300 flows may be introduced to the electroless plating solution 1174 in the vessel 1050 through at least 70 different points of release 1611. In another example, recirculating 6200 flows and replenishment 6300 flows may be introduced to the electroless plating solution 1174 in the vessel 1050 through at least 100 different points of release 1611. In another example, recirculating 6200 flows and replenishment 6300 flows may be introduced to the electroless plating solution 1174 in the vessel 1050 through at least 200 different points of release 1611. In another example, recirculating 6200 flows and replenishment 6300 flows may be introduced to the electroless plating solution 1174 in the vessel 1050 through at least 300 different points of release 1611.

Size and shape of the holes (1610) may vary depending on a given project. Those skilled in the art may choose a proper size and shape of the holes (1610). In one example, the holes (1610) may be circular with a diameter of at least 1 mm. In another example, the holes (1610) may be circular with a diameter of at least 5 mm. In another example, the holes (1610) may be circular with a diameter of at least 10 mm. In another example, the holes (1610) may be circular with a diameter of at least 15 mm. In another example, the holes (1610) may be circular with a diameter of at least 30 mm. In another example, the holes (1610) may be circular with a diameter of at least 50 mm. In another example, the holes (1610) may be circular with a diameter of at least 100 mm.

Even though the two subsystems 1010, 1020 operate independently, they are functionally interdependent as both affect the chemistry balance of the electroless plating system 1000. Therefore, those skilled in the art may need to determine when each subsystem 1010, 1020 operates. In one example, both subsystems 1010, 1020 may operate simultaneously. In another example, the recirculation subsystem 1020 may operate while the replenishment subsystem 1010 is off. In another example, the recirculation subsystem 1020 may be off while the replenishment subsystem 1010 is operating.

What is claimed is:

1. An electroless plating system comprising:

a vessel defining an internal volume;

an electroless plating solution received in the internal volume of the vessel such that the electroless plating solution defines a bath surface, an upper bath region comprising the bath surface, a lower bath region, and a middle bath region between the upper bath region and the lower bath region, the electroless plating solution comprising a solvent, a metal salt, and a reducing agent;

a recirculation subsystem comprising a pump and a recirculation conduit network at least partially immersed in the electroless plating solution, the recirculation conduit network comprising a recirculation inlet portion in fluid communication with a recirculation outlet portion, wherein the recirculation inlet portion is disposed within at least one of the upper bath region and the middle bath region, wherein the recirculation outlet portion is disposed within at least one of the middle bath region and the lower bath region, and wherein the pump is positioned to move the electroless plating solution from the recirculation inlet portion to the recirculation outlet portion; and a replenishment subsystem comprising a replenishment conduit network, a bulk supply of the metal salt, a bulk supply of the reducing agent, and a bulk supply of an inert gas, the replenishment conduit network comprising a replenishment inlet portion in fluid communication with a replenishment outlet portion, the replenishment outlet portion being disposed within at least one of the middle bath region and the lower bath region, the replenishment conduit network further comprising an initial replenishment conduit segment that defines the replenishment inlet portion, the initial replenishment conduit segment being disposed at a non-zero angle relative to a plane that is coincident with the bath surface of the electroless plating solution, wherein the bulk supply of the metal salt, the bulk supply of the reducing agent, and the bulk supply of the inert gas are in selective fluid communication with the replenishment inlet portion of the replenishment conduit network.

2. The electroless plating system of claim 1 wherein the electroless plating solution in the internal volume of the vessel has a height, and wherein the upper bath region extends from about 80 percent of the height to about 100 percent of the height.

3. The electroless plating system of claim 1 wherein the electroless plating solution in the internal volume of the vessel has a height, and wherein the lower bath region extends from about 0 percent of the height to about 20 percent of the height.

4. The electroless plating system of claim 1 wherein the recirculation conduit network comprises an initial recirculation conduit segment that is at least partially immersed in the electroless plating solution in a vertical orientation and defines the recirculation inlet portion.

5. The electroless plating system of claim 4 wherein the recirculation conduit network further comprises:

a second vertical recirculation portion that is fluidly coupled with the initial recirculation conduit segment, the second vertical recirculation portion being configured to move the electroless plating solution from the upper bath region vertically upward over a wall of the vessel; and a third vertical recirculation portion that is fluidly coupled with the second vertical recirculation portion, the third vertical recirculation portion being configured to move the electroless plating solution from the upper bath region vertically downward to the lower bath region, the third vertical recirculation portion that is in fluid communication with the recirculation outlet portion.

6. The electroless plating system of claim 5 wherein the recirculation conduit network further comprises a recirculation diverging junction that divides an initial recirculation flow from the third vertical recirculation portion into two divided recirculation flows.

7. The electroless plating system of claim 6 wherein the recirculation conduit network further comprises a second horizontal recirculation portion that is fluidly coupled with the third vertical recirculation portion at the recirculation diverging junction and defines the recirculation outlet portion.

8. The electroless plating system of claim 7 wherein the second horizontal recirculation portion leads the divided recirculation flows to different parts of the lower bath region.

9. The electroless plating system of claim 1 the non-zero angle is between about 10 degrees and about 50 degrees.

10. The electroless plating system of claim 1 wherein a first metal salt displacement pump is disposed in between the bulk supply of the metal salt and the replenishment inlet portion of the replenishment conduit network for a metered release.

11. The electroless plating system of claim 1 wherein a reducing agent displacement pump is disposed in between the bulk supply of the reducing agent and the replenishment inlet portion of the replenishment conduit network for a metered release.

12. The electroless plating system of claim 1 wherein a pressure regulator is disposed between the bulk supply of the inert gas and the replenishment inlet portion of the replenishment conduit network for a metered release.

13. The electroless plating system of claim 1 wherein the replenishment conduit network further comprises a vertical replenishment portion that is fluidly coupled with the initial replenishment conduit segment, the vertical replenishment portion being configured to move a replenishment mixture vertically downward to the lower bath region, and the vertical replenishment portion that is in fluid communication with the replenishment outlet portion.

14. The electroless plating system of claim 13 wherein the replenishment conduit network further comprises a replenishment diverging junction that divides an initial replenishment flow from the vertical replenishment portion into two divided replenishment flows.

15. The electroless plating system of claim 14 wherein the replenishment conduit network further comprises a second horizontal replenishment portion that is fluidly coupled with the vertical replenishment portion at the replenishment diverging junction and defines the replenishment outlet portion.

16. The electroless plating system of claim 1 wherein the recirculation outlet portion merges with the replenishment outlet portion at an outlet merging junction.

17. The electroless plating system of claim 16 further comprising a sparger in fluid communication with the outlet merging junction.

18. The electroless plating system of claim 1 further comprising an analyzer positioned to measure at least one of a reducing agent concentration in the electroless plating solution, a pH level of the electroless plating solution, and a temperature of the electroless plating solution.

19. An electroless plating system comprising:

a vessel defining an internal volume;

an electroless plating solution received in the internal volume of the vessel such that the electroless plating solution defines a bath surface, an upper bath region comprising the bath surface, and a lower bath region below the upper bath region, the electroless plating solution comprising a solvent, a first metal salt, a second metal salt, and a reducing agent;

a recirculation subsystem comprising a pump and a recirculation conduit network at least partially immersed in the electroless plating solution, the recirculation conduit network comprising a recirculation inlet portion in fluid communication with a recirculation outlet portion, wherein the recirculation inlet portion is disposed within the upper bath region, wherein the recirculation outlet portion is disposed within the lower bath region, and wherein the pump is positioned to move the electroless plating solution from the recirculation inlet portion to the recirculation outlet portion; and a replenishment subsystem comprising a replenishment conduit network, a bulk supply of the first metal salt, a bulk supply of the second metal salt, a bulk supply of the reducing agent, and a bulk supply of an inert gas, the replenishment conduit network comprising a replenishment inlet portion in fluid communication with a replenishment outlet portion, the replenishment outlet portion being disposed within the lower bath region, the replenishment conduit network further comprising an initial replenishment conduit segment that defines the replenishment inlet portion, the initial replenishment conduit segment being disposed at an angle of about 10 degrees to about 50 degrees relative to a plane that is coincident with the bath surface of the electroless plating solution, wherein the bulk supply of the first metal salt, the bulk supply of the second metal salt, the bulk supply of the reducing agent, and the bulk supply of the inert gas are in selective fluid communication with the replenishment inlet portion of the replenishment conduit network.

20. The electroless plating system of claim 1 wherein the electroless plating solution in the internal volume of the vessel has a height, and wherein the upper bath region extends from about 60 percent of the height to about 100 percent of the height.

* * * * *